US005152232A

United States Patent [19]

Crawford

[11] Patent Number: 5,152,232

[45] Date of Patent: Oct. 6, 1992

[54] INCINERATOR APPARATUS

[76] Inventor: James P. Crawford, 1809 Wind Willow Rd., Orlando, Fla. 32809

[21] Appl. No.: 817,375

[22] Filed: Jan. 6, 1992

[51] Int. Cl.[5] ..... F23N 5/02

[52] U.S. Cl. ..... 110/190; 110/188; 110/214

[58] Field of Search ..... 110/188, 190, 214, 212; 431/5, 79

[56] References Cited

U.S. PATENT DOCUMENTS

| | | | |
|---|---|---|---|
| 4,438,705 | 3/1984 | Basic, Sr. | 110/190 X |
| 4,679,268 | 7/1987 | Gurries et al. | 110/190 X |
| 4,913,069 | 4/1990 | Schultz et al. | 110/214 X |
| 5,014,630 | 5/1991 | Looker | 110/212 X |
| 5,095,826 | 3/1992 | Erisson et al. | 110/214 X |

*Primary Examiner*—Edward G. Favors

*Attorney, Agent, or Firm*—William M. Hobby, III; James H. Beusse

[57] ABSTRACT

An incinerator apparatus has a primary incinerator chamber which has a secondary incinerator chamber coupled thereto by a passageway. The primary incinerator chamber has a primary air input into the incinerator chamber and the secondary air chamber has a secondary air input thereinto having a plurality of air input lines with each line having an electric motor control valve, such as a damper motor controlling a damper valve controlling the flow through one of the input lines. A plurality of ultraviolet flame detector ports open into the side of the secondary incinerator chamber, each being spaced a predetermined distance from each other and each having a ultraviolet flame detector positioned therein for sensing the ultraviolet radiation and the flame adjacent the detector in the secondary incinerator chamber. Each ultraviolet flame detector is operatively coupled through electronic controls which includes relays to actuate each of the plurality of electric damper motors to open and close the damper valve responsive to the ultraviolet flame detector signal thereby the secondary air flow is controlled by a flame detector reading the flame position at a plurality of points in the secondary incinerator chamber. One air blower can direct the air to the primary chamber and to the secondary chamber through a plurality of ports into each chamber with the secondary air being increased or decreased responsive to the length of the flame in the secondary chamber to thereby maintain the temperature within a predetermined range within the secondary chamber to ensure complete combustion of the incinerated product.

11 Claims, 4 Drawing Sheets

INCINERATOR APPARATUS

BACKGROUND OF THE INVENTION

The present invention relates to an incinerator and especially to an incinerator having primary and secondary incinerator chambers and sensor controlled air feed into incinerator chambers.

In the past, a wide variety of incineration devices and are usually classified as batch incineration or continuous incineration. Successive batch incineration methods typically utilize combustion in a primary combustion zone followed by an additional combustion with excess secondary air in a secondary combustion zone to ensure complete combustion and the elimination of smoke fumes and odors. Various techniques have been utilized for controlling the rates of primary and secondary air introduced into the primary and secondary combustion chambers and such techniques are generally such that the rate of secondary air is too high and overcooling of the combustion gas occurred in the secondary combustion chamber, especially during the loading of the primary chamber and during the incineration of each batch of waste material when the secondary combustion chamber is below operating temperature. Overcooling is uneconomical in that it waste heat which must be replaced by the burning of extra fuel and, in addition, does not provide sufficient complete combustion to eliminate all of the combustion particles and fails to meet regulatory requirements in the incineration of hospital and medical waste and the like.

In the past, incinerators have included primary and secondary combustion chambers which utilize temperature control and instruments to control the rates of both the primary and secondary air. The primary temperature controller senses the temperature of the combustion gases exiting the primary combustion chamber and adjusts the primary air rate according to control of the temperature of the combustion gases at the selected level. In a similar manner, a secondary air temperature controller senses the temperature of the combustion gases withdrawn from the secondary combustion chamber and adjusts the rate of secondary air to maintain the temperature of such gases at a relatively high selected temperature level. When such incinerators are being operated intermittently with time delays between batches of waste material or between groups of batches of waste material being incinerated, the high temperature level of the gases withdrawn from the secondary combustion chamber often cannot be maintained and overcooling in the secondary chamber takes place. Thus, the maximum rate and combustibility of combustion gases fed into the secondary combustion chamber occurs during the peak incineration stage of each waste batch so that the temperature of the combustion gases produced in the secondary combustion chamber cannot always be maintained at the selected high temperature level during loading and initial incineration steps and final incineration stage of each waste batch and the temperature of the combustion gas produced in the secondary combustion chamber fall below the required or desired temperature level as a result of the intermittent incinerator operation.

Prior U.S. patents which show various waste incinerators and methods of incineration includes the Wright et al. U.S. Pat. No. 4,870,910, in which the rate of secondary air combined with combustion gases in the secondary combustion zone is controlled to maintain the combustion gases withdrawn therefrom at a substantially constant selected temperature level during the peak incineration stage of each waste batch. The air is controlled by temperature sensors along with timer controlled switches to vary the flow of air. In the Lewis U.S. Pat. No. 4,453,474, a method for controlling temperatures in the afterburner of a multiple hearth furnace modulates the amount of combustion air and controls the temperature of the afterburner within certain predescribed limits by splitting the feeding of sludge between waste material handling hearths. The Martin U.S. Pat. No. 4,953,477, shows a method and apparatus for regulating the furnace output of incineration plants which measure the combustion temperature, the flame radiation, or the brightness in the respective combustion zones which are compared with preselected standard values and regulate the flaps in the air supply pipes to guide the combustion air to the individual combustion, zone. The Haftke et al. U.S. Pat. No. 4,635,567, shows a monitoring of the burner operations in a burner using pulverized fuel entrained in the air and controls the combustion by adjustment of the secondary air flow to each of three burners. The rate of flow of the primary and secondary air are determined and a photodiode measures the temperature of the burner flame. The Gitman et al. U.S. Pat. No. 4,861,262, is a method and apparatus for waste disposal which varies the flows of at least two oxidizing gases and . auxiliary fuel in both the primary incinerator and afterburner so as to operate the system under fluxuating waste loading conditions. The Leffler et al. U.S. Pat. No. 4,359,950, is a method of maximizing the reduction efficiency of a recovery boiler by varying the amount of air entering into the boiler through the primary air input until the minimal amount of sulpher dioxide is measured at the exhaust output.

The present invention, on the other hand, is directed at batch incineration of medical and hospital waste materials and the like which requires a predetermined temperature in the secondary incineration chamber and in which a simplified control uses separate ultraviolet detectors in predetermined positions to measure the length of the flame in the secondary chamber and then to individually control a plurality of secondary air inputs responsive to the position of the flame sensed by the ultraviolet sensor. This makes for a reliable and accurate control system to meet the regulatory requirements for a more complete combustion.

SUMMARY OF THE INVENTION

An incinerator apparatus has a primary incinerator chamber which has a secondary incinerator chamber coupled thereto by a passageway. The primary incinerator chamber has a primary air input into the incinerator chamber and the secondary air chamber has a secondary air input thereinto having a plurality of air input lines with each line having an electric motor controlled valve, such as a damper motor controlling a damper valve controlling the flow through one of the input lines. A plurality of ultraviolet flame detector ports open into the side of the secondary incinerator chamber, each being spaced a predetermined distance from each other and each having an ultraviolet flame detector positioned therein for sensing the ultraviolet radiation and the flame adjacent the detector in the secondary incinerator chamber. Each ultraviolet flame detector is operatively coupled through electronic controls which includes relays to actuate each of the plurality of electric damper motors to open and close the damper valves responsive to the ultraviolet flame detector signal so that the secondary air flow is controlled by a flame detector reading the flame position at a plurality of points in the secondary incinerator chamber. One air blower can direct the air to the primary chamber and to the secondary chamber through a plurality of ports into each chamber with the secondary air being increased or decreased responsive to the length of the flame in the secondary chamber to thereby maintain the temperature within a predetermined range within the secondary chamber to ensure complete combustion of the incinerated product.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 2:
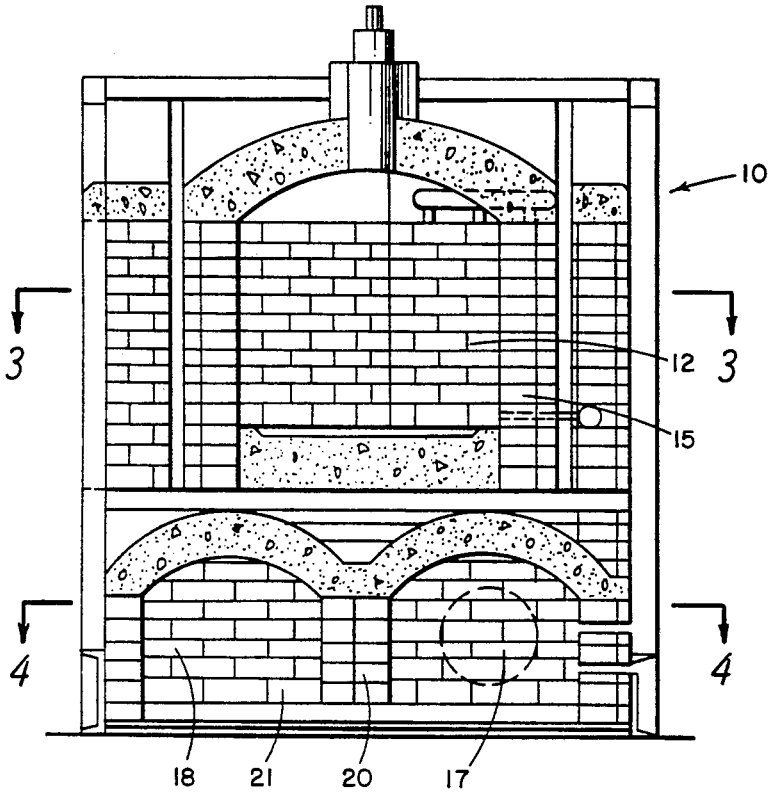
FIG. 2 is a sectional view taken through the incinerator of FIG. 1.
Figure 1:
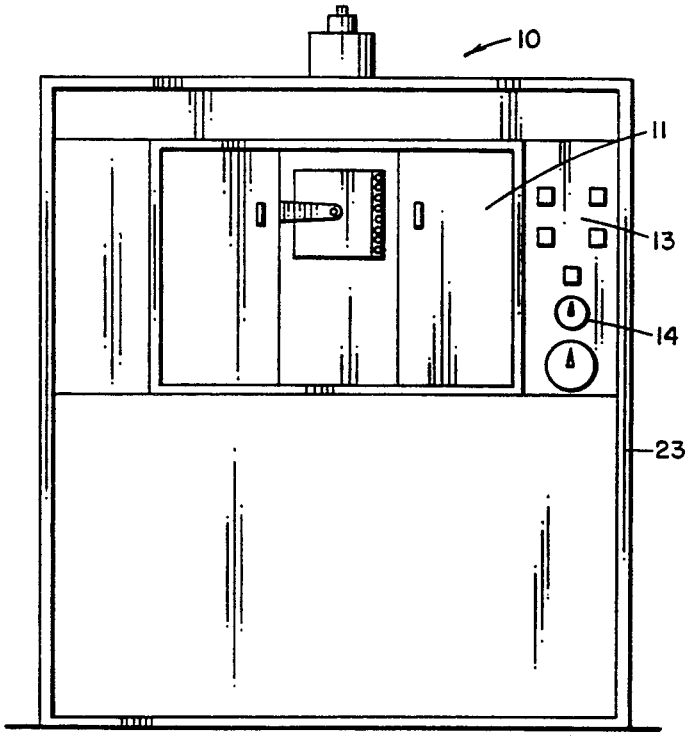
FIG. 1 is a front elevation of an incineration in accordance with the present invention.

Referring to the drawings and especially to FIGS. 1-4, an incinerator 10 is shown in FIG. 1 having a door 11 opening into the primary chamber 12. A control panel 13 having temperature gauges 14 is shown on the front of the incinerator 10. The primary combustion chamber 12 is lined with kiln brick 15 and is connected by a passageway 16 to the secondary combustion chamber 17 which is also lined with refractory brick 18. Secondary chamber 17 has a wall 20 which allows the secondary chamber to bend therearound into an elongated chamber having a second chamber portion 21 located outside the burner flame area and having the exhaust stack 22 connected to the end thereof. The exhaust stack leads from the secondary combustion chamber 17 located below the primary combustion chamber 12 through the stack which passes behind the primary combustion chamber 12. The incinerator has steel walls 23 lined with refractory brick or refractory materials and has one electric motor driven air blower 24 mounted on the rear portion and includes a combustion burner 25 directed into the secondary burner 17 and having a gas line connection 26 and an air line connection 27 and passing through the combustion opening 28 to direct the flame down the elongated secondary burner chamber 17. The primary combustion chamber similarly has a combustion burner 30 having a gas inlet 31 and a combustion air inlet 32 connected through an air line 33 to the blower 24. A combustion burner 30 extends through the opening 33 for directing the flame into the primary combustion chamber 12.

Figure 3:
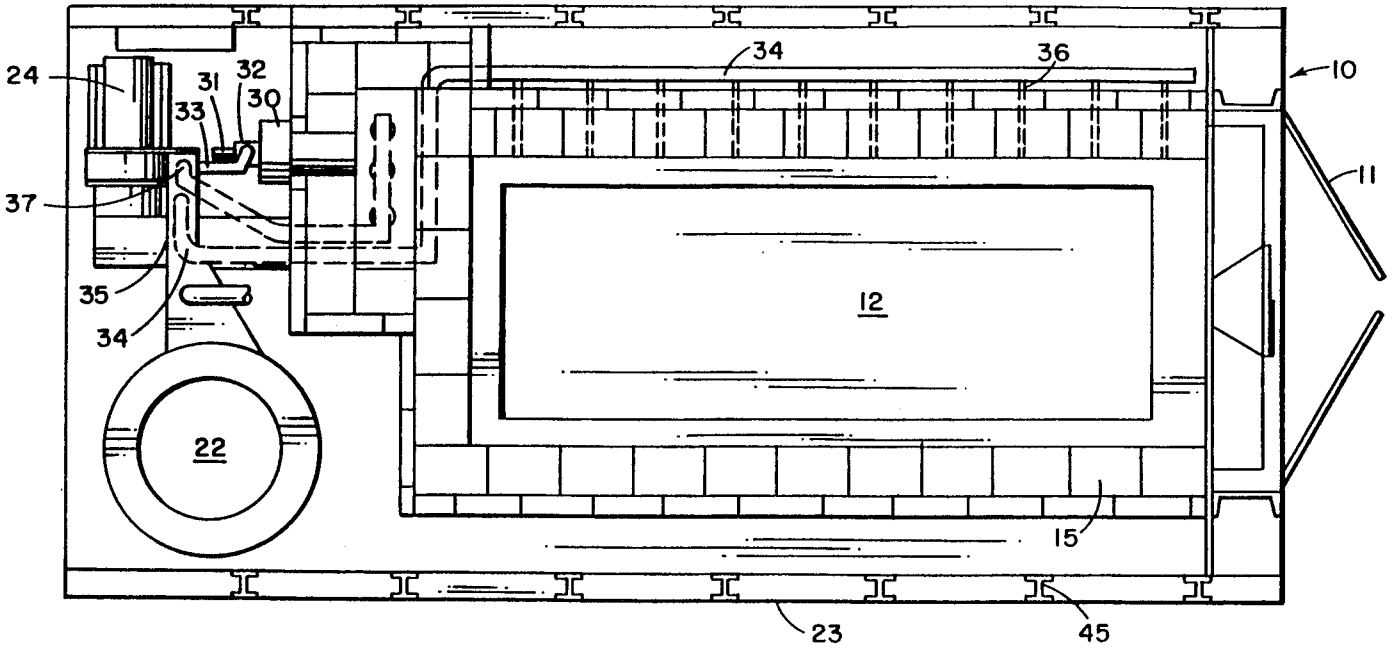
FIG. 3 is a sectional view taken on a line 3—3 of FIG. 2.

As can also be seen in FIG. 3, an air line 34 connects from a plenum 35 along one side of the primary combustion chamber 12 and has a plurality of individual air tubes 35 feeding air into the primary combustion chamber through a plurality of the tubes 35 along one side of the primary chamber. The air is also being fed from the plenum 35 into the burner 30 through the pipe 33. In addition, the plenum 35 has an air line 37 extending the distribution of the air into the secondary chamber 17.

Figure 4:
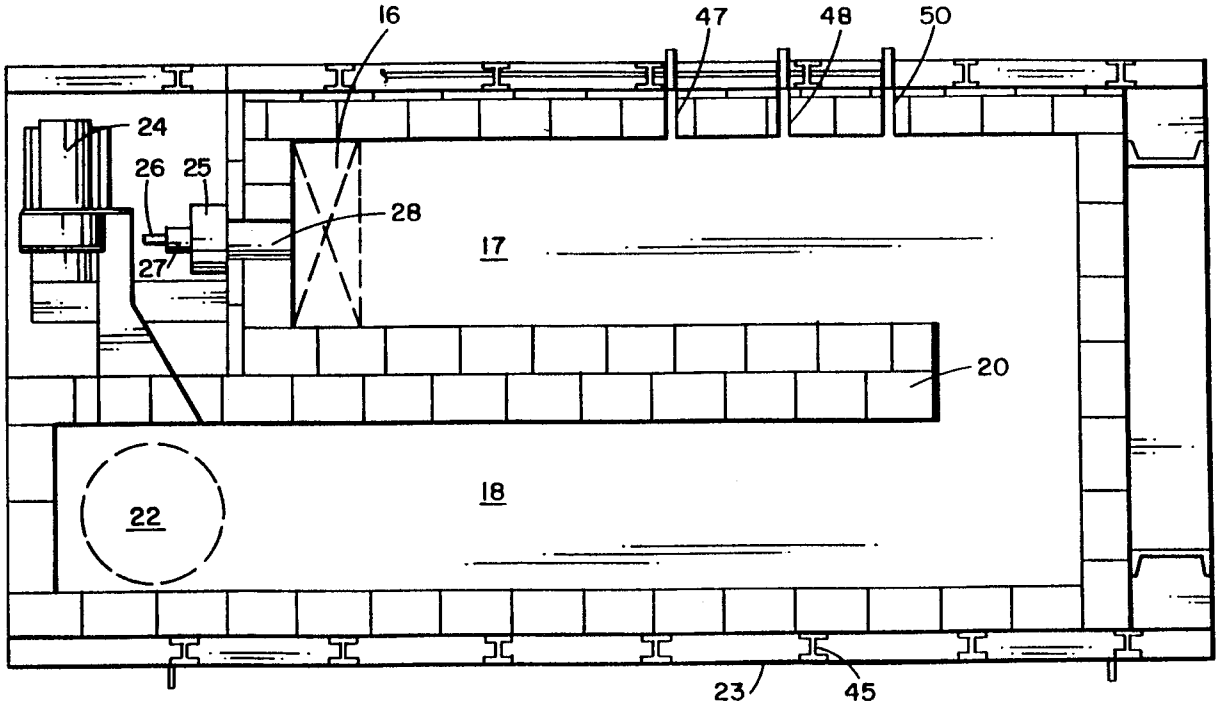
FIG. 4 is a sectional view taken on the line 4—4 of FIG. 2.
Figure 5:
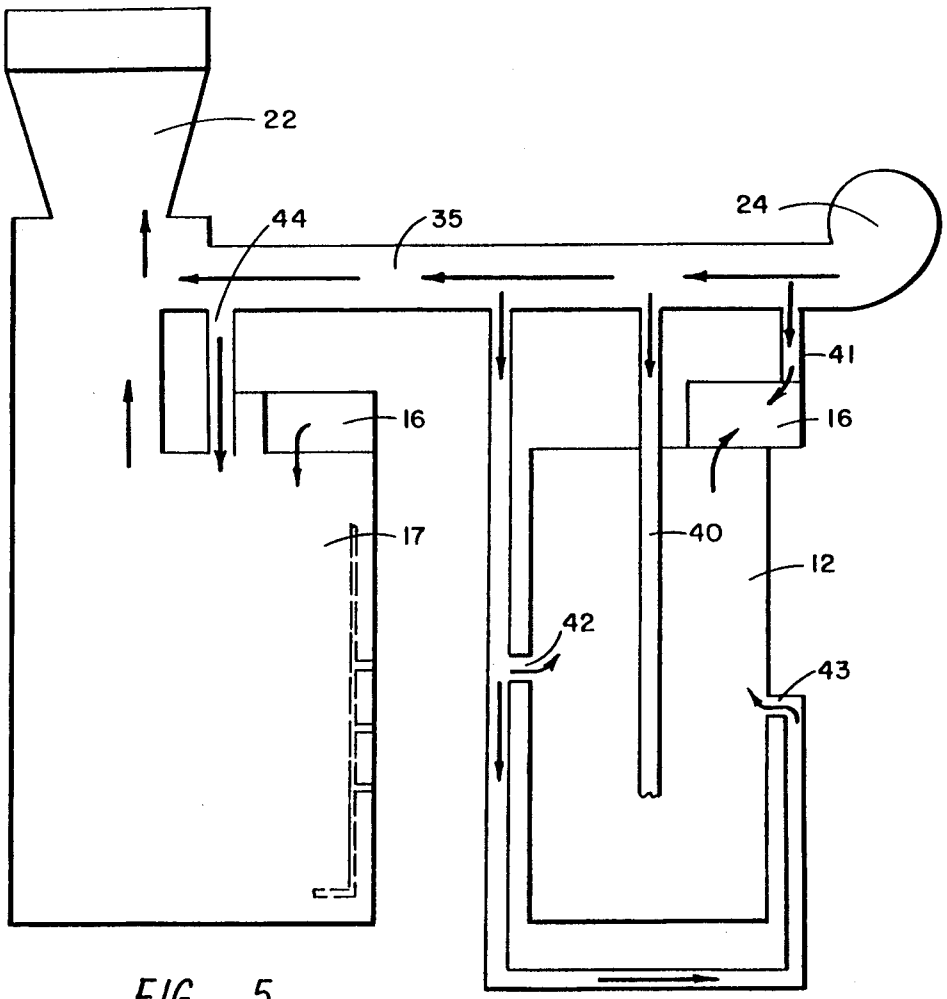
FIG. 5 is an air flow schematic of the incinerator of FIGS. 1-4.

The air flow pattern can be seen in the air flow schematic of FIG. 5 having the blower 24 feeding into a plenum line 35 which feeds directly into the stack 22 but also having a plurality of air lines 38 for the flow of air of the primary combustion chamber 40 for the burner air and 41 for the throat air adjacent the passageway 16 between the primary combustion chamber and the secondary combustion chamber. The combustion air from the pipe 38 opens a plurality of openings 42 and 43. Also, a plurality of openings 44 entering the secondary combustion chamber along with the heated air and solids through the passageway 16 from the primary combustion chamber. As can also be seen in FIGS. 3 and 4, the incinerator 10 is built with steel walls 23 but having a plurality of reinforcing I-beams 45 reinforcing the sides adjacent the refractory lining.

Figure 7:
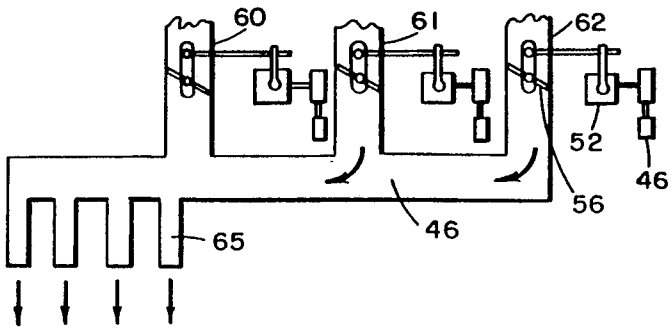
FIG. 7 is an air flow schematic with a plurality of sensors for controlling the air flow to the secondary combustion chamber.
Figure 6:
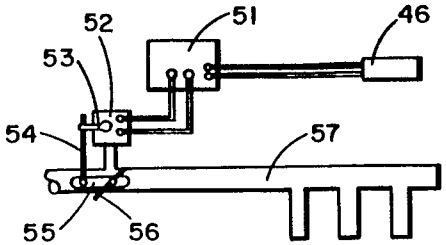
FIG. 6 is a sensor and air control schematic for the air flow to the secondary burner.

Referring now to FIGS. 6 and 7, the operation of the secondary air feed is illustrated in which a plurality of ultraviolet detector sensors 46 are mounted in detector ports 47, 48, and 50, as shown in FIG. 4. Each sensor 46 is connected to an electronic control box 51 which provides the power to the sensor 46 and also takes the sensed signal sensing the position of the flame in front of the sensor to activate a relay to direct power to a damper motor 52 specifically associated with each sensor 46. Damper motor 52 moves an air 53 which moves the linkage 54 to rotate a damper arm 55 which rotates a valve or damper member 56 to open or close the air flowing through the line 57.

As seen in FIG. 7, three individual sensors 46 are each connected to a separate damper motor 52 and accompanying linkage to operate a separate damper 56 and is used to turn on each one of the air inlet lines 60, 61, and 62 responsive to the sensor 46 reading. Each of the air inlet lines 60, 61, and 62 feed into a common air line 64 which then feeds through a plurality of combustion air lines 65. However, by opening and closing each air line 60, 61, and 62 with a damper valve 56, the amount of air that flows into the common air line 64 is controlled so that the amount of air entering the secondary combustion chamber through the air line 65 is varied responsive to the sensor readings of the flame position. In FIG. 6, the control box 51 can be utilized to not only open and close the damper but to vary its position responsive to the size of the voltage signal put out by the sensor 46.

As seen in FIG. 4, the three ports 47, 48, and 50 each have an ultraviolet flame sensor 46 mounted therein and each reads whether the flame in the secondary burner 17 reaches the point 47, 48 or 50 from the flame generated through the throat 28 of the burner 25. The sensors can then add or reduce air depending on which sensor is reading the flame from the burner to control the temperature of the output of the secondary combustion chamber 17 and to maintain the flame which varies in accordance with the temperature and combustion product being fed into the secondary burner through the passageway 16 from the primary combustion chamber and constantly monitors the flame and immediately adds or reduces the air flow into the secondary combustion chamber.

Figure 8:
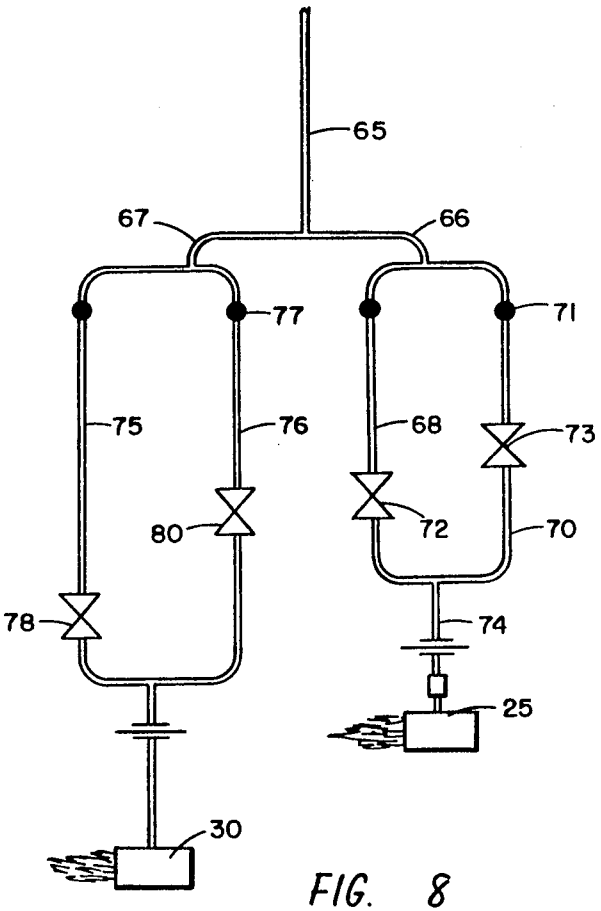
FIG. 8 is a gas flow schematic of the gas flow for the primary and secondary combustion chambers of the incinerator of FIGS. 1-7.

FIG. 8 shows a schematic of the gas supply for the burners with the gas supply line 60 feeding line 66 for the secondary burner and a line 67 for the primary burner. The gas line 66 divides into two lines 68 and 70, each having a cut off gas cock 71, and line 68 having a solenoid actuated valve 72 therein and gas line 70 having a solenoid control valve 73 therein so that the amount of gas fed to the line 74 can be controlled by turning on or off either or both solenoid valves 72 and 73 which are then fed to the secondary burner 25. Similarly, the gas line 67 divides into two lines 75 and 76 each having a gas cock 77 therein with gas line 75 having a solenoid control valve 78 therein while gas line 76 has the solenoid valve 80 therein for controlling the flow of gas to the primary burner 30. The solenoid control valves for controlling the gas in combination with the controls of the air flow provides a simplified method of controlling the primary and secondary burner temperatures and flames to meet the temperature and combustion requirements provided in the codes for the combustion of medical and hospital wastes and other critical incineration as performed in the smaller incinerators.

It should be clear at this point that an incinerator apparatus has been provided which controls the operation of the flow of air from a single blower into the incinerator combustion chamber and especially into the secondary combustion chamber and varies that flow in accordance with the flame position and which can also vary the control in accordance with temperature measurements, if desired, which can also be used in the control of burner flames and gas feed to produce a desired temperature and combustion and also provides a simplified control with a minimum of moving parts. However, the present invention should not be construed as limited to the forms shown which are to be considered illustrative rather than restrictive.

I claim:

1. An incinerator apparatus comprising:

a primary incinerator chamber;

a secondary incinerator chamber coupled to said primary incinerator chamber by a passageway;

a primary air input into said incinerator chamber;

a secondary air input into said secondary incinerator chamber, said secondary air input having a plurality of input lines and a plurality of electric motor controlled valves, each valve controlling the flow through one input line;

a plurality of flame detector ports opening into said secondary incinerator chamber and each flame detector port being spaced in a predetermined relationship to each other;

a plurality of ultraviolet flame detectors, one positioned in each of said flame detector ports for sensing ultraviolet radiation in said secondary incineration chamber adjacent each flame detector and each ultraviolet flame detector being operatively coupled to one electric motor controlled valve to thereby open and close said valve responsive to the flame detector signal, whereby secondary air flow is controlled by flame detectors reading the flame at a plurality of points in said secondary incinerator chamber.

2. An incinerator apparatus in accordance with claim 1 in which said primary chamber is located over said secondary chamber.

3. An incinerator apparatus in accordance with claim 1 in which each said electric motor controlled valve is a damper motor controlling a damper.

4. An incinerator apparatus in accordance with claim 2 in which said incinerator apparatus has one air blower for said secondary air input and primary air input.

5. An incinerator apparatus in accordance with claim 4 in which said air blower is connected to a plenum passageway with separate air lines connected from said plenum to primary and secondary incinerator chambers.

6. An incinerator apparatus in accordance with claim 3 in which said incinerator apparatus has three ultraviolet flame detectors.

7. An incinerator apparatus in accordance with claim 6 in which said plurality of electronic motor controlled valves includes three electronic damper motors one for each of three dampers.

8. An incinerator apparatus in accordance with claim 7 in which each said damper includes a butterfly valve.

9. An incinerator apparatus in accordance with claim 8 including a plurality of gas lines connected to said secondary incinerator chamber and one solenoid valve located in each gas line for controlling the gas flow in each gas line.

10. An incinerator apparatus in accordance with claim 9 including a plurality of gas lines connected to said primary incinerator chamber and one solenoid valve located in each gas line for controlling the gas flow in each gas line.

11. An incinerator apparatus in accordance with claim 1 in which said plurality of flame detector ports and flame detectors therein are spaced in a line in said secondary incinerator chamber for thereby measuring the length of the flame in said secondary chamber by each flame detector detecting a flame adjacent thereto.

* * * * *